United States Patent [19]

Coffman

[11] 4,149,811

[45] Apr. 17, 1979

[54] STYLE HANDLE

[76] Inventor: Melvin C. Coffman, 1751 Champa, Denver, Colo. 80202

[21] Appl. No.: 619,448

[22] Filed: Oct. 3, 1975

[51] Int. Cl.[2] ..... A46B 5/02

[52] U.S. Cl. ..... 401/6; 15/443

[58] Field of Search ..... 401/6; 15/443–445, 15/135–138; D19/45, 51

[56] References Cited

U.S. PATENT DOCUMENTS

| | | | |
|---|---|---|---|
| D. 136,595 | 11/1943 | Pleasants | D19/45 |
| D. 190,263 | 5/1961 | Kaplan | D19/51 X |
| 794,329 | 7/1905 | Whitehouse | 401/6 |
| 843,767 | 2/1907 | Plach | 15/443 |
| 878,004 | 2/1908 | Jahn | 15/443 |
| 1,160,832 | 11/1915 | Borsella | 15/443 |

FOREIGN PATENT DOCUMENTS

| | | | |
|---|---|---|---|
| 1191434 | 4/1959 | France | 15/443 |
| 11546 | 1/1896 | Switzerland | 15/443 |

*Primary Examiner*—Stephen C. Pellegrino
*Attorney, Agent, or Firm*—Frank C. Lowe

[57] ABSTRACT

A style handle for writing and engraving instruments. The base portion of this style, which is gripped when in use, consists of three, essentially-flat surfaces arranged in a triadic spiral at a selected pitch conforming with an individual's finger grip when the style is held in a normal manner. So held, the edges of the spiral lie in the grooved portions between the individual's thumb and fingers with the thumb and fingers resting upon the flats of the spiral in a relaxed, natural manner. Also, the inclination of the spiral forms an abutment which permits the style to be held with less pressure when pressing it against a writing or working surface.

10 Claims, 7 Drawing Figures

STYLE HANDLE

The present invention relates to styles, that is, writing instruments, engraving tools and like hand tools, and more particularly to the handles for such styles which are specially formed to facilitate gripping the same. As such, the invention will be hereinafter called a "style handle", and sometimes, simply a "handle".

The use of styles for writing, engraving and similar manual operations extends to antiquity. The several instruments and tools which are technically referred to as styles are all constructed in a similar manner with an elongated handle holding the stylus, a pen, pencil or other tool, at one end of the handle. While individual writers and artisans may grip the handle in somewhat different ways, the gripping is nevertheless essentially similar in that the handle will usually be gripped between the thumb and the index finger with the side of the individual's third finger forming a base against which the thumb and index finger press.

Often, because of a nervous dispostion of the writer or artisan, or because the style handle is slippery, the writer or artisan will grip the handle so tightly that he can create a strain in his hand, especially if he is using the style over a long period of time. The result is a writer's cramp or finger bump. Perhaps the main reason for gripping the handle with too tight a pressure resides in the fact that this handle, ordinarily a cylindrical rod, can easily slip and in the case of an ordinary pencil, there is no provision to inhibit this slipping action. Thus, style handles are sometimes formed with an enlargement at their base to provide an abutment whereagainst the end of the index finger may rest. Some types of engraving tools are manufactured in an even more elaborate manner by providing an actual shelf-like abutment about the base of the handle. However, elaborations of a pencil or pen handle are usually missing on conventional, commercial pens and pencils, simply as an economy in production. For example, many types of ball point pens are manufactured by extruding a thick-walled tube to form the handle of the pen.

Another problem that exists in the provision of a style handle, and especially the handles of engraving tools, resides in the need to prevent rotation of the style while it is being used. Many common pens and pencils are hexagonal in section to provide for flat surfaces which may be more easily gripped, and often, a pen, pencil or engraving tool may even be fluted for this purpose so that it will not rotate when being gripped.

The expedients hereinabove set forth point up the fact that there is a need for an improved style handle for pens, pencils and engraving tools which is contoured to be most effectively held by the writer or artisan in a relaxed, natural manner and without the necessity of squeezing the handle to avoid unwanted sliding or rotation of the style while he is using the same. A number of pen handles, or "style handles" have been proposed for this purpose, but heretofore, the designs have either been ineffective or too complicated.

The present invention was conceived and developed with the foregoing and other considerations in view and comprises, in essence, a style handle of an exceedingly simple form, a triad of spiraled edges at the gripping section of the handle. These edges may be called "arrises" since the trough portions between them are flute-like. These flute-like trough portions between the ridges are essentially flat. However, these so-called "flats" may be either crowned or dished a slight amount. This spiral is at a long pitch so that there is only a partial rotation about the handle at the designated gripping section of the handle. The pitch is such as to permit the flats between the spiral edges to lie snugly against the user's fingers and thumbs with the arrises lying in the grooves between the writer's fingers and thumb. It was discovered that this simple arrangement, the long-pitch arrises, presented curved, gripping surfaces which conform to the natural form of an individual's thumb and fingers when holding a pen or other tool. Thus, the writer is encouraged to write in a relaxed manner.

It follows that an object of the present invention is to provide a novel and improved style handle which provides a spiraled gripping surface conforming to the hand of a writer or artisan so that he may hold the style handle in a relaxed, natural manner conducive of good penmanship and workmanship.

Another object of the invention is to provide a novel and improved style handle having a triad of unique, spiraled gripping surfaces arranged in an essentially symmetrical manner, permitting the handle to be held at any of several positions, or by providing a slight emphasis on one of the spirals which may permit the handle to be held at only a single position as is necessary with some types of pens and engraving tools.

Another object of the invention is to provide a novel and improved style handle for writing instruments and engraving tools which permits a writer or artisan to grip the handle with no more pressure than is necessary to press a stylus against a sheet or work piece. For example, the handle of a pen may be held with a very light pressure when writing upon a tablet while the handle of an engraving tool may be held with a greater, but not an excessive pressure, as when an artisan is cutting into the surface being engraved.

Another object of the invention is to provide a novel and improved style handle having a natural, strain-free, gripping surface which will naturally improve the quality of an individual's writing or engraving skills.

Another object of the invention is to provide a novel and improved style handle with a strain-free, gripping surface at its base, which is a simple, neat-appearing, versatile, low-cost unit.

With the foregoing and other objects in view, my present invention comprises certain constructions, combinations and arrangements of parts and elements as hereinafter described, defined in the appended claims, and illustrated in preferred embodiment by the accompanying drawing in which:

Figures 1, 2, 3, 4, 5, 6, 7:
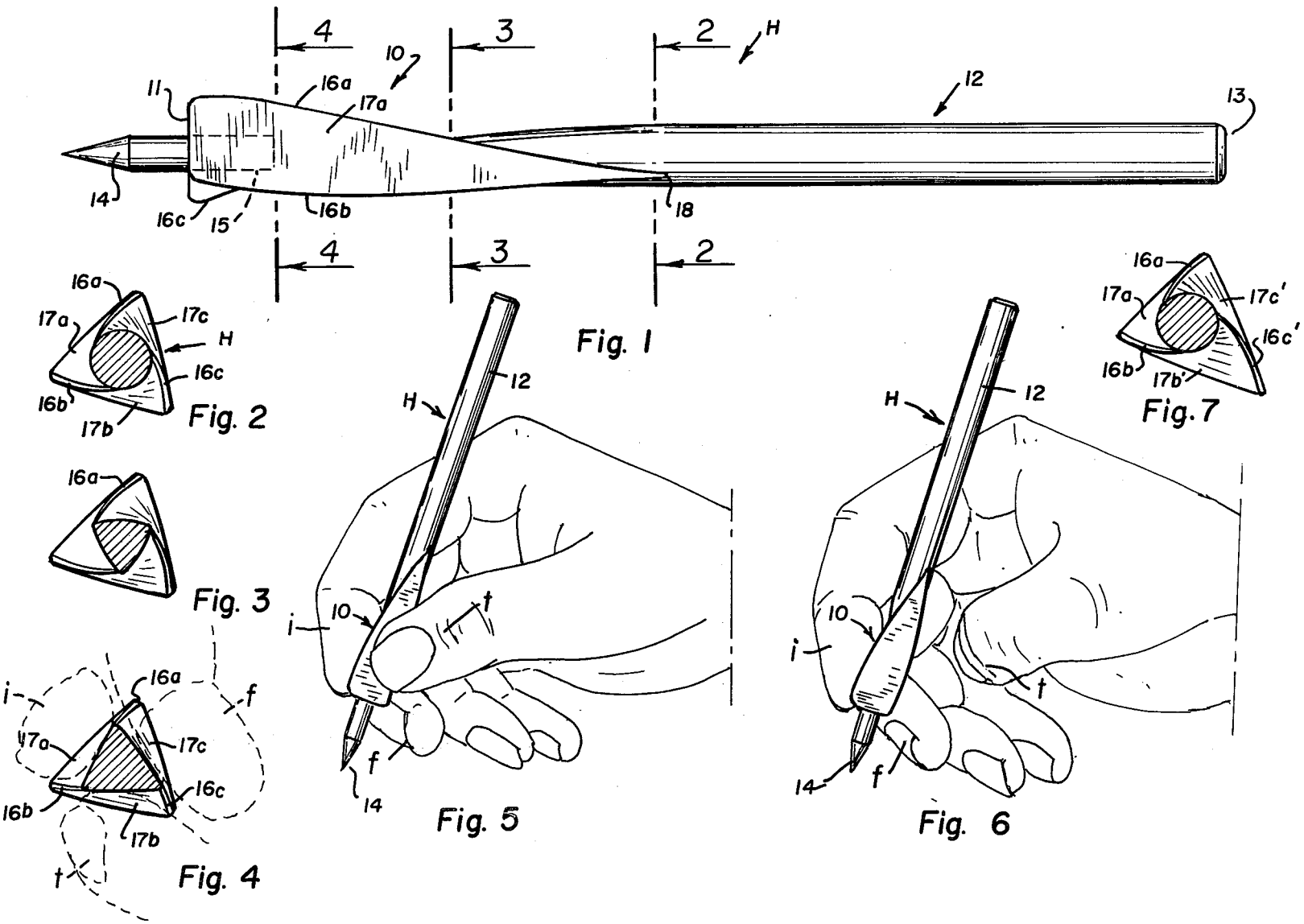
FIG. 1 is a plan view of a style, depicted with a scribing point formed according to the present invention.
FIG. 2 is a sectional view as taken from the indicated line 2—2 at FIG. 1.
FIG. 3 is a sectional view as taken from the indicated line 3—3 at FIG. 1.
FIG. 4 is a sectional view as taken from the indicated line 4—4 at FIG. 1, and with dotted lines indicating the thumb and finger positions upon the handle.
FIG. 5 is a perspective view of a person's hand holding the style in a natural manner, in accordance with the principles of the invention.
FIG. 6 is a perspective view of a person holding the style, as at FIG. 4, but tucked under his fingers to illustrate the manner in which the pen is held between the index and third fingers.
FIG. 7 is a sectional view similar to FIG. 2, but showing a slightly modified construction where the flutes are not in proportion.

Referring more particularly to the drawing, the style handle H is an elongated, essentially-straight member having a spiraling, triangular gripping section 10 adjacent to the base end 11 and a cylindrical, haft section 12 adjacent to the opposite upper tip 13 of the handle and with the two sections merging near the center of the handle H. This handle is formed of any suitable, rigid material such as wood, metal or plastic, such as is used in the manufacture of pencils, pens and the like. Preferably, it will be made of a selected, high quality plastic material by injection molding since the spiraled form of the gripping section, hereinafter described, is more easily manufactured by injection molding than by turning or extrusion operations commonly used in the manufacture of handles for pencils, pens and the like. However, the mode of manufacture and the material selected is not critical insofar as the present invention is concerned.

In accordance with conventional arrangements, a scribing point 14 extends from the base end of the handle H and is mounted in a convenient socket 15 extending into the body of the handle. It is to be understood that the scribing point 14 and the manner in which it is mounted within a socket 15 in the handle is representative of any of several types of marking and engraving devices, such as pens, pencils, ballpoint cartridges and engraving tools, all of which are commonly mounted upon the base end of a handle, such as the handle H herein illustrated. As a matter of convenience, the same will sometimes be hereinafter referred to as a "scribing tool".

In accordance with the present invention, the gripping section 10 of the handle is formed as a triad of spiraled edges, that is, arrises 16*a*, 16*b* and 16*c* with spiraled flats 17*a*, 17*b* and 17*c* between these arrises, thus producing twisting rod-like form, triangular in section, and with the diameter defined by the arrises 16*a*, 17*b* and 16*c* tapering from a maximum at the base 11 to reduce to the diameter of the haft section 12 and merge thereinto as at a junction 18. The resulting gripping section twists clockwise where the handle is viewed from the haft end 13, as illustrated, and the clockwise twist is advantageous whenever the handle is to be used for right-handed persons. A counter-clockwise twist is preferable when the handle is to be used for left-handed persons. However, for certain purposes, and by certain individuals, the opposite may be true. The arrises are blunted, smooth edges, which lie between a user's fingers, as hereinafter described. The flats 17*a*, 17*b* and 17*c* of this twisted holding section are illustrated as being slightly convex in section, but they may be flat or slightly convex or concave and function equally as well when used as hereinafter described.

In the construction best shown at FIGS. 2, 3 and 4, eacharris 16*a*, 16*b* and 16*c*, and each flat 17*a*, 17*b* and 17*c* may be identical to the others in a symmetrical arrangement so that the handle may be described as having three-fold symmetry about its longitudinal axis. With such symmetry, the handle may be rotated so that it can be held at three different positions, which is advantageous when using certain types of scribing tools such as, for example, ball-point pens. This simple, symmetrical arrangement may be modified by enlarging one arris 16*c* as shown at FIG. 7. When so enlarged, the handle can be comfortable in only one position. This is advantageous when the scribing tool is a quill pen or an engraving chisel.

As indicated in the drawing, the pitch of the spiral or twist of the triangular gripping section 10, compared with the diameter of the handle H. is quite long. The gripping section 10 is to be held within the embrace of an artisan's, or writer's, fingers as illustrated, and is, thus, approximately two to three inches long. The twist in this reach is approximately 90 to 120 degrees; thus, the pitch of the spiral, for a 360 degree twist, will be between 6 and 12 inches, and thus, may even exceed the length of the entire handle. This is in contrast with some types of spiral handles where the pitch is comparatively short.

The haft section 12 of this handle H is illustrated as being cylindrical with a flat tip end 13. However, this construction may be varied to provide any desired form such as a taper or even an enlarged head adjacent to the end. This haft 12 may also be of any suitable length, short or comparatively long, according to the desires of the manufacturer, but it should be long enough to fit comfortably in an artisan's or writer's hand and long enough to be easily balanced when being used.

FIGS. 5 and 6 illustrate the manner in which the handle H will normally be held by an artisan or writer. It is gripped in the same manner as a conventional pen or pencil, with the gripping section 10 lying between the individual's thumb, index finger and the third finger. The three flat, spiraled surfaces 17*a*, 17*b* and 17*c* are held by the individual's thumb and fingers while the arrises 16*a*, 16*b* and 16*c* lie in the grooves where the individual's thumb and fingers touch each other. For example, referring to FIG. 4, the arris 16*a* may lie in the groove where the individual's index finger i and the third finger f come together; the arris 16*b* will lie in the groove where the index finger i and his thumb t come together; and the arris 16*c* will lie in the groove where the thumb t and his third finger f come together.

Whenever a normal individual holds his hand in a writing position with his thumb, index finger and third finger together, the grooves between these fingers form a natural twist, or spiral, which will, essentially, match the spiral of the gripping section 10. Thus, the handle will naturally fit the individual's grip upon the gripping section of te handle. The third finger f forms a base whereagainst one flat surface 17*c* lies when the stylus handle is held in a writing position as illustrated, with the haft section lying against the individual's hand near the knuckle of his index finger as illustrated. The tip of the individual's index finger i and the tip of the thumb t will then rest against the other two flat surfaces of the handle, 17*a* and 17*b* respectively. The twisting arrises will lie in the groove between the individual's thumb and fingers. This will prevent unwanted rotation of the handle while it is being held and used. The spiral form also minimizes any tendency to slip in his hand when the scribing tool 14 is being pressed against a workpiece surface. The spiralled surface actually forms abutments, angled with respect to the handle axis, to provide a longitudinal component of thrust when gripping and pressing against the handle. Not only will the individual discover a maximum degree of comfort and control when holding the handle, he will find that the spiraled gripping section naturally forces him to hold the handle in a proper manner for good, effective engraving and penmanship.

I have now described my invention in considerable detail. However, it is obvious that others skilled in the art can arrange and devise alternate and equivalent constructions which are nevertheless within the spirit and scope of my invention. Hence, I desire that my protection be limited, not by the constructions illustrated and described, but only by the proper scope of the appended claims.

What is claimed is:

1. A style handle adapted to be gripped by a normal finger grip at a gripping portion adjacent to the scribing point at the base end of the handle, and including a haft portion extending beyond the gripping portion, said haft portion being essentially circular in cross section, wherein the gripping portion has substantially trifold axial symmetry about its longitudinal axis and comprises:

(a) three substantially identical uniformly varying twisting grip surfaces defining a continuous triadic spiral commencing at the base end of the handle and rotating axially to the haft portion, and wherein:

(b) the edges of said spiral, where the grip surfaces join, are spaced at said base end of the handle at a lateral spacing which is greater than the haft diameter and the spacing of these edges decreases toward the haft to merge into the surface of the haft, and wherein:

(c) the grip surfaces are widest adjacent to said base, narrow towards the haft and merge into the surface of the haft as the edges merge into the surface of the haft.

2. The style handle defined in claim 1, wherein said gripping portion has trifold symmetry about its longitudinal axis.

3. The style handle defined in claim 1, wherein said surfaces between the edges are essentially flat.

4. The style handle defined in claim 1, wherein said surfaces between the edges are slightly concave.

5. The style handle defined in claim 1, wherein said surfaces between the edges are slightly convex.

6. The style handle defined in claim 1, wherein said haft portion is essentially circular in cross-section.

7. The style handle defined in claim 1, wherein said spiral twists in a clockwise direction when viewed from the haft end of said handle.

8. the style handle defined in claim 1, wherein said spiral twists in a counterclockwise direction when viewed from the haft end of said handle.

9. The style handle defined in claim 1, wherein said continuous triadic spiral rotates axially through an arc of at least about 90° C.

10. The style handle defined in claim 9, wherein said arc is approximately 90 to 120 degrees.

* * * * *